United States Patent [19]

Kobayashi et al.

[11] 4,016,392

[45] Apr. 5, 1977

[54] PAN DETECTOR FOR INDUCTION HEATING APPARATUS

[75] Inventors: Takao Kobayashi; Keizo Amagami; Takumi Mizukawa; Tadao Toyooka, all of Kadoma, Japan

[73] Assignee: Matsushita Electric Industrial Co., Ltd., Japan

[22] Filed: Jan. 28, 1975

[21] Appl. No.: 544,845

[30] Foreign Application Priority Data

Feb. 5, 1974 Japan ..... 49-15142

[52] U.S. Cl. ..... 219/10.49; 219/10.77; 321/18

[51] Int. Cl.² ..... H05B 5/04

[58] Field of Search ..... 219/10.49, 10.77, 10.75; 321/18, 14, 16

[56] References Cited

UNITED STATES PATENTS

| | | | |
|---|---|---|---|
| 3,566,243 | 2/1971 | Landis | 321/18 |
| 3,596,165 | 7/1971 | Andrews | 321/18 |
| 3,821,509 | 6/1974 | Amagami et al. | 219/10.49 |
| 3,823,297 | 7/1974 | Cunningham | 219/10.77 |
| 3,898,410 | 8/1975 | Peters | 219/10.49 |

*Primary Examiner*—Bruce A. Reynolds
*Attorney, Agent, or Firm*—Robert E. Burns; Emmanuel J. Lobato; Bruce L. Adams

[57] ABSTRACT

Electromagnetic coupling between a pan or utensil load to be heated by magnetic induction and a source of high frequency magnetic flux is sensed by detecting a current which is indicative of the electromagnetic coupling by means of a current transformer. The detected current is compared with a reference level. Intermittent generation of the magnetic flux is commenced when, for example, a small magnetic metal object is inadvertently placed as a load with the result that the detected current becomes lower than the reference level. This allows intermittent check for the presence and absence of the inadvertently placed load for subsequent cooking operations and minimization of the heat generated therein.

5 Claims, 4 Drawing Figures

PAN DETECTOR FOR INDUCTION HEATING APPARATUS

BACKGROUND OF THE INVENTION

The present invention relates generally to induction heating apparatus, and more particularly to a pan detector incorporated in the induction heating apparatus for detecting the size of a pan load to prevent electrical energy from being wasted when such load is below a predetermined level.

Induction heating cooking apparatus are known for heating cooking utensils of a metal which is magnetic such as iron by magnetic induction which produces eddy currents in the utensil, instead of by direct resistance heating. Because of the invisibility of the magnetic flux, there is a likelihood of the attendant inadvertently placing a small body of a magnetic metal such as spoons and forks over the source of alternating magnetic flux. No matter how small such a body of metal may be, it will be heated to a substantial extent. The attendant, when attempting to remove it from the source of magnetic flux, will suffer a burn on his fingers by the heat if he handles it directly. Furthermore, cooking utensils may frequently be interchanged while the apparatus remains energized, and there will be substantial periods of no utensils being placed over the source of magnetic flux and electrical energy will be wasted during such periods.

SUMMARY OF THE INVENTION

An object of the invention is therefore to provide a pan detector for an induction heating apparatus for detecting the pan load and preventing and permitting, respectively, generation of magnetic flux.

Another object of the invention is to prevent possible harmful effect produced by removal by hand of inadvertently placed, undesirable utensils.

A further object is to reduce wasted electrical energy during the periods of no utensils being placed over the source of magnetic flux while the apparatus is being energized.

Still another object is to detect the pan load by sensing the current that contributes to heat generated without causing loss of useful electrical energy.

Another object is to provide a pan detector which is capable of detecting the load smaller than a predetermined constant value even if the apparatus is manually set to any desired heating level and even if the alternating current power supply potential which energizes the apparatus fluctuates, in voltage level.

Still another object is to provide a pan detector which, when operated, intermittently generates magnetic flux for intermittent checking for the placement of proper pan load to permit the induction heating apparatus to be instantly brought into normal working condition to continuously generate alternating magnetic flux.

BRIEF DESCRIPTION OF THE DRAWINGS

These and other objects and features of the present invention will be understood from the following description taken in conjunction with the accompanying drawings, in which.

DESCRIPTION OF THE PREFERRED EMBODIMENTS

Briefly, a pan detector of the invention is incorporated in an induction heating cooking apparatus. The induction heating apparatus comprises generally a full wave rectifier coupled to a commercial or residential alternating current power source to supply a full wave rectified, unfiltered excitation potential to a pair of terminals, an induction heating coil which electromagnetically couples with a load located thereover, and a static power conversion, or chopper inverter circuit coupled to the pair of terminals. The inverter circuit includes a silicon-controlled rectifier and a feedback diode connected in inverse parallel relation thereto for generating a high voltage ultrasonic frequency wave that energizes the induction heating coil to produce eddy currents in the body of the load to thereby heat it to a substantial extent. The pan detector comprises means for sensing a current which is indicative of the magnitude of electromagnetic coupling between the induction heating coil and the load. The detected current is compared with a reference level. When the detected current level is below the reference level, energization of the induction heating coil is intermittent to provide an intermittent check for the presence and absence of the load. In order to maintain the point of detection constant over the varying range of magnetic flux generated from the induction heating coil, the reference level is variable with a manual setting of the electromagnetic flux in such a way as to conform with the resultant variations in the detected current, and is also variable with possible fluctuations in the alternating current power potential. The current to be detected may be detected from any point of the apparatus in so far as that current is indicative of the electromagnetic coupling between the coil and the load. Such current may be an input current which flows into the full wave rectifier from the alternating current power supply or a net magnitude of current components, one flowing through the silicon-controlled rectifier in one direction during one half cycle of the ultrasonic frequency minus the other that flows through the feedback diode in the opposite direction during the other half cycle, the resultant current being termed in this specification a net current.

Figure 1:
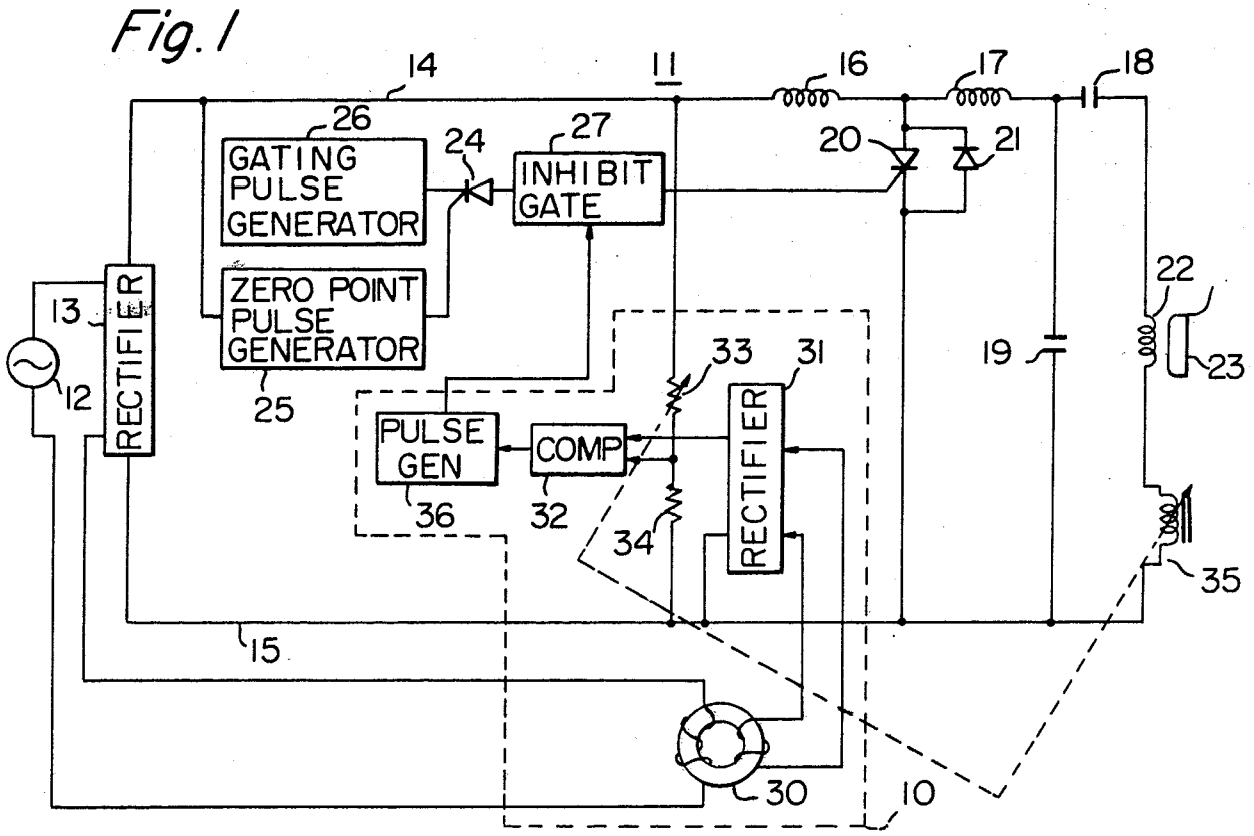
FIG. 1 is a schematic circuit block diagram of a pan detector in accordance with a first preferred embodiment of the invention.

Referring now to FIG. 1 there is shown a pan load detector 10 of the invention incorporated in an induction heating apparatus 11 constructed in a manner generally similar to that described in U.S. Pat. No. 3,821,509 issued to the same assignee. The circuit of FIG. 1 is energized from a conventional commercial or residential alternating current power supply source 12 which is connected to a full wave rectifier 13 of conventional construction which full wave rectifies the alternating current supply potential and supplies its output to a pair of power supply buses or terminals 14 and 15. The output from the full wave rectifier 13 is unfiltered, and hence the potential appearing across the terminals 14 and 15 is unidirectional and in the form of a series of halfwave sinusoidal-shaped rectified high voltage pulses that drop substantially to zero voltage level intermediate each halfwave pulse and have a frequency double that of the alternating current supply.

The full wave rectifier 13 supplies the excitation potential for a chopper-inverter circuit comprised by a filter inductor 16, a commutating inductor 17, a filter capacitor 18, a commutating capacitor 19 and a bidirectional conducting, gate controlled, semiconductor thyristor switching device formed by a power rated silicon-controlled rectifier (SCR) 20 and a reversely poled parallel connected, feedback diode 21. The SCR 20 and feedback diode 21 are connected across the junction between the inductors 16 and 17 and the terminal 15, and serve to excite at a relatively high frequency of the order of 20–30 kiloherz which drives an induction heating coil 22 which, in turn, electromagnetically couples to a pan load 23 located in overlying relation to the coil 22.

Figure 3A:
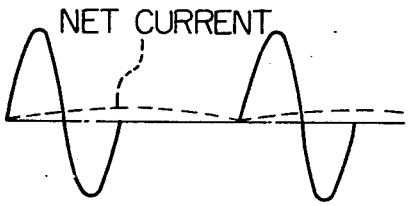
FIGS. 3A and 3B show sinusoidal waveforms of a current to be detected by the pan detectors.
Figure 3B:
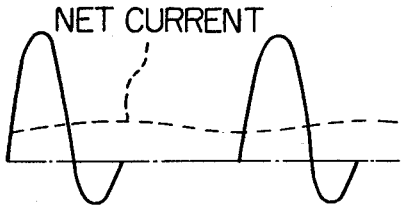

Energization of the ultrasonic frequency chopper-inverter circuit takes place only during intervals while a soft starting zero point energization switching element SCR 24 is conducting. The zero point switching SCR 24 is rendered conductive by a zero voltage point sensing and pulse generating circuit 25. The purpose of the soft start zero point switching control is to assure that the energization potential is supplied across the chopper inverter only at or near the beginning of the rectified, unfiltered, sinusoidallly shaped halfwave, high voltage pulse appearing at the output of the full wave rectifier 13. In this manner, this is avoidance of surge charging of the commutating components with initial high voltage that would produce certain undesirable consequences such as misfiring of the chopper-inverter switching SCR 20 due to the lack of a sufficient gating signal at a desired turn-on point. A gating pulse generator 26 supplies a train of gating pulses at the rate of ultrasonic frequency which are applied to the control electrode of the SCR 20 via inhibit gate 27 which is normally conducting. Therefore, it is seen that SCR 20 will be made conductive during each positive half cycle of the ultrasonic frequency under the control of the gating pulses and nonconducting during the negative half cycle during which energy stored in the commutating capacitor 19 will be discharged through the feedback diode 21. If no loading is placed over the induction heating coil 23, the commutating current that flows through the diode 21 has equal magnitude to the current that flows during the positive half cycle and thus there is substantially no net current present in the inverter circuit (see FIG. 3A), and if a load of substantial magnitude is placed there will be an increase in current during the positive half cycle and a decrease during the negative half cycle with the resultant increase in the net current, as is illustrated in FIG. 3B. Since the net current that flows through the inverter circuit is proportional to the electromagnetic coupling between the coil 22 and load 23, the current supplied from the alternating current power supply 12 to the full wave rectifier 13 is also proportional to the electromagnetic coupling and it is seen that such current is utilized to detect the size of the pan load.

In accordance with the first preferred embodiment of the invention, the pan detector 10 comprises a current sensing means in the form of a current transformer 30 having its primary connected in series circuit relation to the alternating current power supply 12 and the full wave rectifier 13 and its secondary connected to a rectifier 31 which full wave rectifies the current induced in the secondary of the transformer 30 and delivers its unidirectional voltage output to a comparator 32. A voltage setting circuit comprised by a series-connected variable resistor 33 and fixed resistor 34 is connected across the bus lines 14 and 15 to supply a voltage determined by the setting of the variable resistor 33 to the comparator 32. Power control means such as a variable inductor 35 is connected in series circuit relation with the induction heating coil 22 in order to control the amount of heat generated in the pan load by adjustment of the electromagnetic coupling between the coil 22 and the pan load 23. Since the output delivered from the rectifier 31 varies in accordance with both the variation in the electromagnetic coupling and possible variation in alternating current power supply potential of source 12, it is preferable that the preset voltage level is also variable with such factors for purposes of detecting a small loading under the preset value. Therefore, the variable resistor 33 is preferably interlocked or ganged with the variable inductor 35 such that voltage at the junction between resistors 33 and 35 varies in proportion to the amount of adjustment made to control the electromagnetic coupling. Since the voltage setting circuit is connected across the bus lines 14 and 15, the reference voltage is also caused to vary in accordance with the possible variation in alternating current power supply potential.

The comparator 32 delivers its output when the output from rectifier 31 is below the preset value. The comparator output is applied to a pulse generator 36 which may comprise an astable multivibrator to produce a train of rectangular pulses of a predetermined pulse length to block the passage of gating pulses to the SCR 20, so that SCR 20 is intermittently energized. It will be seen that when a small loading is inadvertently placed over the induction heating coil 22, the input current flowing through the primary of current transformer 30 will be low enough so that the comparator 32 delivers its output and the coil 22 will be intermittently energized. The ratio of active period to nonactive period of the pulses derived from pulse generator 36 is selected in such manner that the inadvertently placed small utensil may not be heated excessibly to cause a burn on the fingers of the attendant when he touches it in an attempt to remove it from the electromagnetic coupling with the coil 22.

Figure 2:
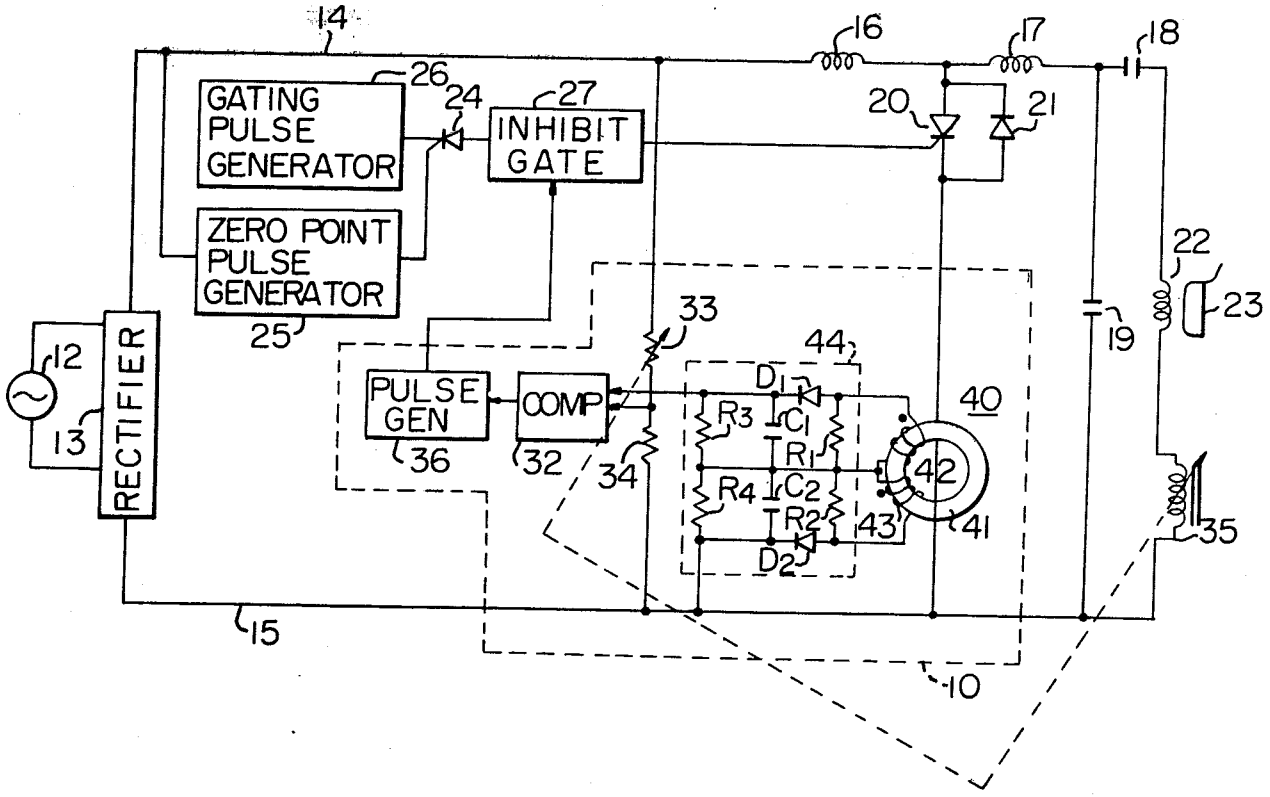
FIG. 2 is a schematic circuit block diagram of a pan detector in accordance with a second preferred embodiment of the invention.

A second preferred embodiment is shown in FIG. 2, in which similar reference numbers designate components similar to those of FIG. 1. In this embodiment, the net current that flows in the inverter circuit is detected by the provision of a current transformer 40 which may comprise a ring-shaped magnetic core 41. Part of the inverter circuit which connects the SCR/diode pair to the bus line 15 extends through the core 41 to serve as a primary winding. Windings 42 and 43 are series-connected to each other to serve as a secondary winding. Winding 42 is shunted by a resistor $R_1$. A diode $D_1$ is connected to the resistor $R_1$ to allow the potential developed thereacross due to the current flowing through SCR 20 during each positive half cycle to be impressed across a capacitor $C_1$, whose capacitance being selected at an appropriate value to accumulate the charge which flows thereinto at the rate of ultrasonic frequency at which SCR 20 turns on and off. In like manner, winding 43 is shunted by a resistor $R_2$ and diode $D_2$ permits each negative half cycle of the ultrasonic frequency wave to be applied to a capacitor $C_2$ of a similar capacitance value to that of $C_1$. Resistors $R_3$ and $R_4$ are provided to shunt the capacitors $C_1$ and $C_2$, respectively, and series-connected to each other. Diodes $D_1$ and $D_2$ are connected to the opposite ends of the series-connected secondary windings 42 and 43 so that voltage develops across the resistors $R_3$ and $R_4$ in opposition to each other, so that the resultant voltage developed across the opposite ends of the series-connected resistors $R_3$ and $R_4$ indicates the net current of the chopper-inverter circuit. The circuit components in dashed rectangle 44 connected to the secondary windings of the current transformer 40 thus serve the functions of rectifying each half cycle of the high frequency energization currents, smoothing the rectified output for each half cycle to a substantially constant level and providing subtraction between the rectified, substantially constant voltages to obtain the net current value. The comparator 32 delivers its output when the level of output from circuit 44 is below the preset value determined by the resistors 33 and 34 as previously described. Upon the occurrence of the comparator output, pulse generator 36 is brought into operation to generate a train of pulses to permit intermittent energization of coil 22 in a manner similar to that described in the foregoing exemplary embodiment.

The intermittent energization of coil 22 permits the pan detector 10 to intermittently check for the presence and absence of the undesirable small utensil or metal objects placed over the coil 22 and upon the removal of such objects the inverter circuit is instantly brought into energization for subsequent cooking operation.

The foregoing description shows only preferred embodiments of the present invention. Various modifications are apparent to those skilled in the art without departing from the scope of the invention which is only limited by the appended claims. Therefore, the embodiments shown and described are only illustrative, not restrictive.

What is claimed is:

1. An induction heating apparatus comprising, a resonant circuit including an induction heating coil inductively coupled in operation to an inductance load; means including a gate-controlled switching device and a unidirectional conducting device connected in inverse parallel relation therewith, for supplying said resonant circuit with current pulses to cause resonance in said resonant circuit at a frequency sufficient to cause heating of the inductance load coupled to said heating coil; detecting means for generating a first signal indicative of the magnitude of the inductive coupling between said inductance load and the heating coil; comparing means for generating a second signal when the first signal reaches a variable reference level; manual adjusting means for permitting the adjustment of the inductive coupling at a desired value; means for varying the variable reference level in accordance with the adjustment of the inductive coupling; and means responsive to the second signal for enabling said current pulse supplying means at intervals which are sufficiently long so that no significant heating occurs in said inductance load.

2. An induction heating apparatus as claimed in claim 1, wherein said detecting means comprises a current transformer responsive to the current resulting from the resonance in said resonant circuit in response to said current pulses, first polarity sensitive means connected to the output of the transformer and having means to pass signals of a first polarity to said comparing means, said second polarity sensitive means connected to the output of the transformer and having means to pass signals of a second polarity to said comparing means.

3. An induction heating apparatus comprising, a resonant circuit including an induction heating coil inductively coupled in operation to an inductance load; a gate-controlled switching device and a unidirectional conductive device connected in inverse parallel relation therewith, a power supply circuit connected in operation to a source of alternating current to supply an excitation potential across the main terminals of the gate-controlled switching device, means for supplying a train of gating-on pulses to the control gate of said gate-controlled switching device for permitting said switching device to be switched on and off at a frequency tuned to the resonant circuit to generate in said resonant circuit an energization current which drives the induction heating coil to cause heating of the inductance load; detecting means for generating a first signal representative of the magnitude of the inductive coupling between said inductance load and the heating coil; comparing means for generating a second signal when the first signal reaches a variable reference level; manual adjusting means for permitting the adjustment of the inductive coupling at a desired value; means for varying the variable reference level in accordance with the adjustment of the inductive coupling; and means responsive to the second signal for enabling said gating-on supplying means at intervals which are sufficiently long so that no significant heating occurs in said inductance load.

4. An induction heating apparatus as claimed in claim 3, wherein said detecting means comprises a current transformer responsive to the current in said power supply circuit, and means for rectifying said current in said power supply circuit into a substantially constant value.

5. An induction heating apparatus as claimed in claim 3, wherein said detecting means comprises a current transformer responsive to the current resulting from the resonance in said resonant circuit in response to said current pulse, first polarity sensitive means connected to the output of the transformer and operable to pass signals of a first polarity to said comparing means, said second polarity sensitive means connected to the output of the transformer and operable to pass those signals of a second polarity to said comparing means.

* * * * *